US005159641A

United States Patent [19]

Sopko et al.

[11] Patent Number: 5,159,641

[45] Date of Patent: Oct. 27, 1992

[54] MICROPHONE CIRCUIT CONTROL MECHANISM FOR BREATHING APPARATUS

[75] Inventors: Timothy J. Sopko, Springville; William D. Siska, Elma, both of N.Y.; Vernon Lenz, Yakima, Wash.

[73] Assignee: Figgie International, Inc., Willoughby, Ohio

[21] Appl. No.: 739,151

[22] Filed: Jul. 31, 1991

[51] Int. Cl.[5] ..... H04R 25/00

[52] U.S. Cl. ..... 381/169; 381/187; 381/168; 128/201.19; 379/175

[58] Field of Search ..... 381/169, 187, 168; 181/21, 22; 128/201.19; 379/430, 424, 175; 367/132; 405/186; 200/83 L, 83 J, 83 Q

[56] References Cited

U.S. PATENT DOCUMENTS

| | | | |
|---|---|---|---|
| 3,292,618 | 12/1966 | Davis et al. | 367/132 |
| 3,850,168 | 11/1974 | Ferguson et al. | 128/201.19 |
| 3,859,619 | 1/1975 | Ishihara et al. | 200/83 L |
| 4,119,797 | 10/1978 | Wollert | 381/110 |
| 4,154,981 | 5/1979 | Dewberry et al. . | |
| 4,181,835 | 11/1980 | Stadler et al. | 73/745 |
| 4,382,159 | 5/1983 | Bowditch | 381/120 |
| 4,799,263 | 1/1989 | Bäziger et al. | 381/157 |
| 4,885,796 | 12/1989 | Loftus et al. | 381/169 |
| 4,901,356 | 2/1990 | Bauer | 381/169 |

FOREIGN PATENT DOCUMENTS 0396904 8/1933 United Kingdom .

*Primary Examiner*—Jin F. Ng
*Assistant Examiner*—Huyen D. Le
*Attorney, Agent, or Firm*—Hodgson, Russ, Andrews, Woods & Goodyear

[57] ABSTRACT

A microphone circuit control mechanism which is utilized to control the output of a microphone (20) disposed in a breathing mask (12) the microphone circuit extending to a communications device (22) and wherein the microphone circuit control mechanism includes a switch (86) in the microphone circuit, which switch can be toggled between "on" and "off" states in response to a drop in pressure within a pressure sensing chamber (44). The switch (86) is a single-pole double-throw magnetic reed switch which is disposed within the pressure sensing cavity (44), which cavity is in a demand regulator (14). The regulator includes a valve (27) capable of admitting air under pressure into the pressure sensing chamber when required. The magnetic reed switch (86) is toggled in response to movement of a magnet (112) carried by a portion (64) of a valve operating means (30) which portion moves in response to a drop in pressure in the sensing chamber (44). The reed switch (86) includes a pigtail (100) which has been configured and positioned in such a manner relative to the permanent magnet as to provide an adjusting structure for adjusting the toggle position.

19 Claims, 3 Drawing Sheets

MICROPHONE CIRCUIT CONTROL MECHANISM FOR BREATHING APPARATUS

TECHNICAL FIELD

The present invention relates generally to a microphone circuit control mechanism which is utilized to control the output of a microphone to a communications device, and more particularly to a microphone circuit control mechanism of the type set forth above which is capable of toggling a switch in a microphone circuit between "on" and "off" states in response to a drop of pressure within a pressure sensing chamber.

BACKGROUND OF THE INVENTION

Many forms of breathing apparatus are known in the art which include a breathing mask. Such breathing masks may be either a full-face mask or a half-face mask. In many cases a microphone is disposed within the breathing mask so that the wearer of the mask can communicate with others either through a radio or a communications amplifier worn by the wearer of the breathing mask. The breathing apparatus may be either a continuous flow system in which there is a constant flow of air into the breathing mask or a demand system where air is introduced into the mask only in response to a system pressure drop. Virtually all self-contained breathing apparatus today are of the demand type. Communication in such apparatus is adversely effected by the introduction of air into the mask in response to a system pressure drop, since typically a hissing noise is made when the air is introduced into the mask, which hissing noise will be picked up by the microphone and communicated unless some means is provided to either decrease or shut off the output of the microphone during inhalation.

A large number of proposals have been made in the past for controlling this problem. In one approach the microphone is mounted at a location where it is not likely to pick up the sound of incoming air. This approach is shown in British Patent 396,904. Another approach has been to mount the microphone within the breathing mask but to use a sound canceling microphone where background sounds impinge upon both sides of the microphone, such microphones being well known in the art. Another approach, as shown in U.S. Pat. No. 4,154,981, is to attenuate the output of the microphone when high noise levels are present.

By far the most common approach which has been used for controlling the output of a microphone has been simply toggling the microphone circuit between "on" and "off" conditions. This can be done manually, but manual actuation of course requires the user of the breathing apparatus to switch the microphone "on" and "off". This switching requires both manual and mental effort. In some circumstances, for example an emergency escape situation, thoughts may be elsewhere and hands may not be free. U.S. Pat. No. 4,382,159 proposes to overcome the disadvantages of manual switching by providing a blow-actuated microphone which switches a microphone between its "on" and "off" states in response to a blowing effort. While this proposal overcomes the disadvantages of requiring a manual switch, it still requires a mental effort on the part of the wearer. The above patent also makes reference to voice-actuated keying devices which switch the mechanism between on and off states, and one such approach is shown in U.S. Pat. No. 4,119,797 which uses a voice signal to switch the communications system between its "on" and "off" states. Typically such devices cannot distinguish between voice and noise and therefore such devices have not met with substantial commercial success. It has also been proposed to add a sensor which senses the flow in the gas line to a breathing mask, such additional equipment being shown in U.S. Pat. Nos. 4,181,835 and 4,799,263. While such approaches require neither mental nor manual effort, they have the disadvantage in that they are add-on devices disposed in the flow line to the breathing mask. These devices cause a pressure drop in the gas line. In addition, failure of the unit could plug the breathing line and render the breathing mask unusable.

OBJECTS AND SUMMARY OF THE INVENTION

It is an object of the present invention to provide a microphone circuit control mechanism which overcomes the disadvantages of the prior art, which control mechanism will toggle a switch in a breathing-mask mounted microphone circuit, the control mechanism being directly responsive to a drop of pressure within an integral pressure sensing cavity.

More specifically, it is an object of the present invention to dispose a microphone circuit control mechanism within a pressure sensing chamber of a demand regulator, which chamber or cavity is at the same pressure as the interior of a breathing mask when worn by a wearer, and which control mechanism will, in response to a reduction of pressure within the pressure sensing cavity, cause a switch to be moved from one state to another to toggle a microphone from its communication mode to a noncommunicating mode.

In summary the above objects, as well as other objects, are accomplished by providing a single-pole double-throw magnetic reed switch within a pressure sensing chamber in a demand regulator for a breathing mask, which regulator includes a valve capable of admitting air under pressure into the pressure sensing cavity during a demand condition, the magnetic reed switch being toggled in response to movement of a magnet carried by a portion of the valve operating means, which portion moves during a reduction of pressure within the pressure sensing cavity.

The above structure as well as the foregoing objects and other objects and advantages of the present invention will become more apparent after a consideration of the following detailed description taken in conjunction with the accompanying drawings in which a preferred form of the present invention is illustrated.

DETAILED DESCRIPTION

Figure 1:
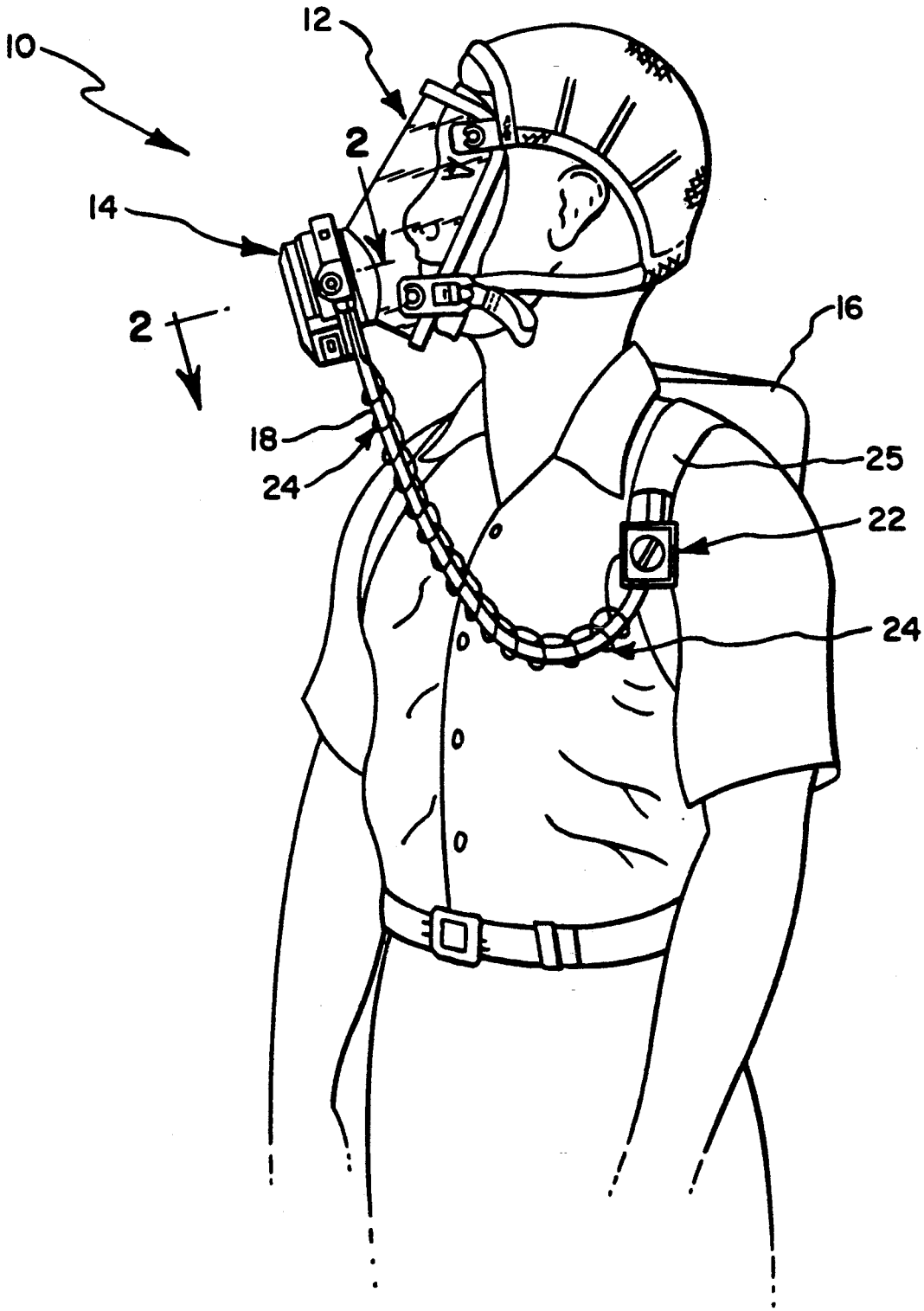
FIG. 1 is a view showing a person wearing a breathing mask and pressure demand regulator with which the microphone circuit control mechanism of this invention may be utilized, this view further illustrating a communications device associated with the pressure demand regulator.

Referring first to FIG. 1, the microphone circuit control mechanism of this invention is adapted to be utilized with a breathing apparatus of the type shown in this figure. Thus, the breathing apparatus is indicated generally at 10, the apparatus including as its principal components a breathing mask indicated generally at 12 and a demand regulator indicated generally at 14, the demand regulator being mounted directly upon the breathing mask. The breathing apparatus is connected to a source of air under pressure which source may be a pressure tank 16 carried on the back of the wearer of the breathing apparatus by a suitable harness. The tank being connected to the mask through an air line 18. A demand regulator of the type illustrated in the drawings will admit air into the breathing mask only when there is a demand for the air. In addition, the air within the mask is maintained at a positive pressure to prevent the ingress of ambient air along with the contaminants that may be found in the ambient air. Therefore, this type of demand regulator is called a pressure demand regulator, and virtually all self-contained breathing apparatus are of the pressure-demand type. The breathing apparatus illustrated in the drawings is of the type sold by Scott Aviation under the trademark "AIR-PAK".

Figure 2:
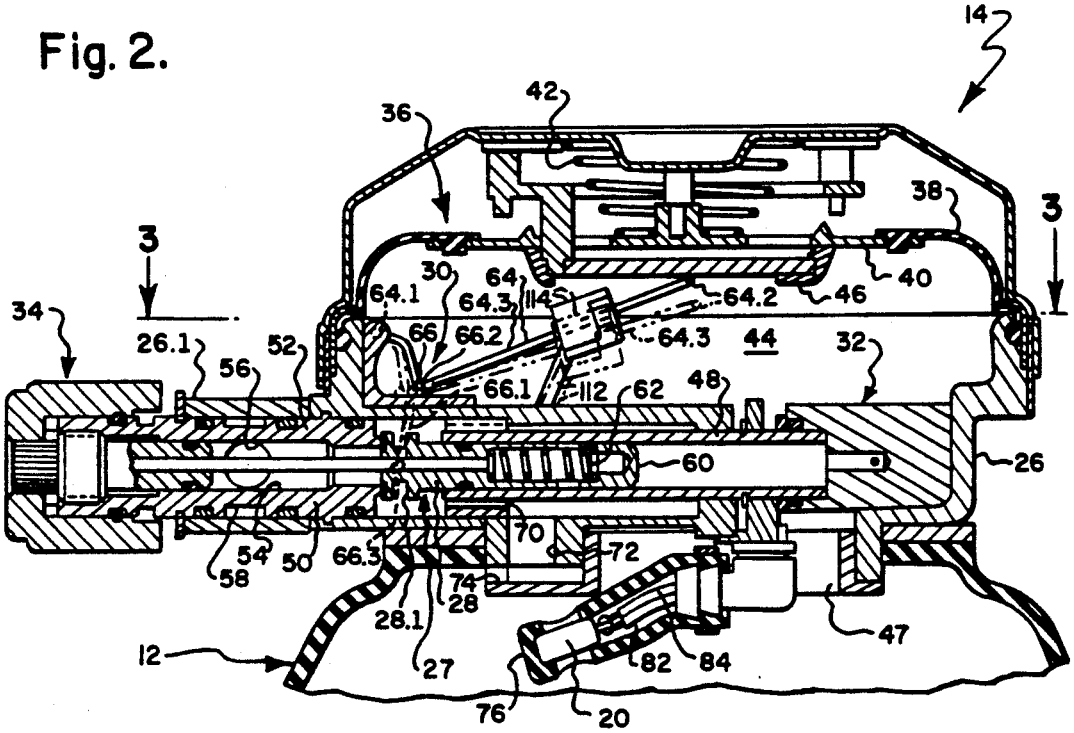
FIGS. 2 and 3 enlarged sectional views of the pressure demand regulator shown in FIG. 1, FIG. 2 being taken generally along the line 2—2 in FIG. 1 and FIG. 3 being taken generally along the line 3—3 in FIG. 2.

A microphone circuit is associated with the breathing apparatus, the microphone circuit including a microphone 20 shown in FIG. 2. The microphone is preferably of the sound canceling type, the microphone being mounted within the breathing mask 12 and being connected to a communications device 22 (FIG. 1) by means of an electrical line 24 which spirals about the air line 18. The communications device may be radio. Alternatively it can be a voice amplifier which includes a speaker. The communications device is preferably worn upon a shoulder strap 25 which forms part of the harness which supports the air cylinder 16 on the back of the wearer.

The pressure demand regulator 14 includes a housing 26 which is mounted on the breathing mask or face mask 12 in any conventional manner. The housing 26 is provided with a demand valve assembly 27 which includes a poppet valve 28 and demand valve operating means indicated generally at 30. The regulator may further include alarm means indicated generally at 32 and purge means indicated generally at 34, neither the alarm means nor the purge means having any relevancy to the present invention. The demand valve operating means 30 include a diaphragm assembly which is indicated generally at 36. The diaphragm assembly includes a flexible annular portion 38 and a rigid central portion 40. The diaphragm assembly is spring-biased by means of a positive pressure spring 42 which acts on one side of the diaphragm to move the diaphragm towards a pressure sensing chamber or cavity 44 disposed between the portion of the housing 26 which supports the valve 28 and the diaphragm. The diaphragm is further provided with an exhaust valve 46.

Figure 3:
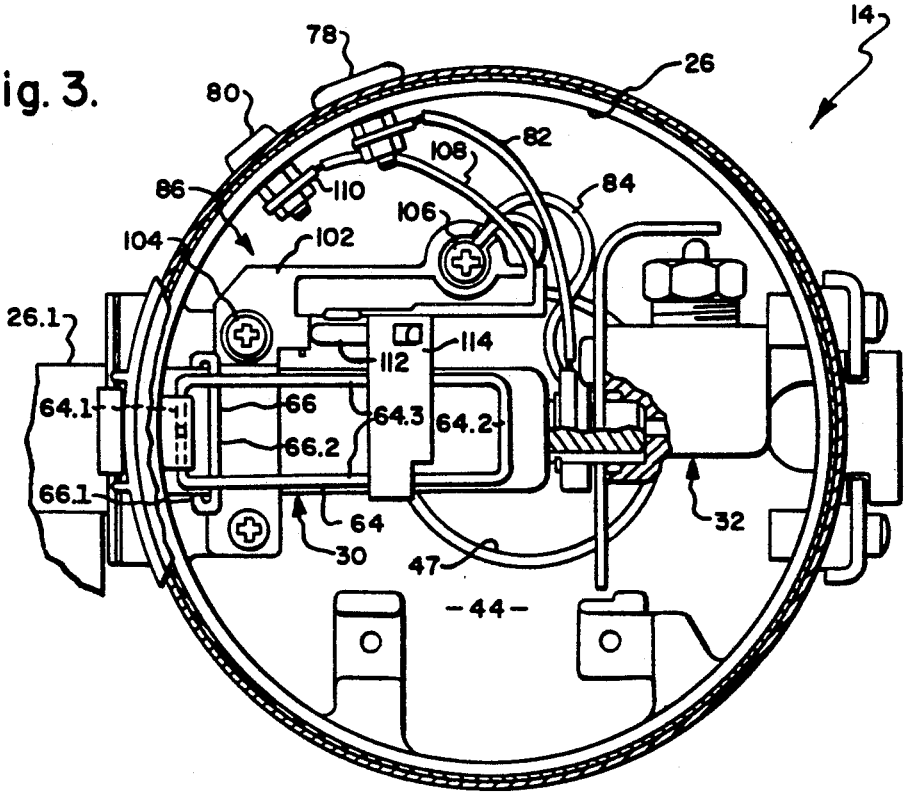

The pressure sensing cavity 44 communicates with the interior of the breathing mask 12 by means of a relatively large passageway 47 shown in FIG. 3. As the passageway 47 is quite large, the pressure within the mask 12 will be essentially the same as the pressure within the pressure sensing cavity 44.

As can be seen, the demand valve 27 includes, in addition to the poppet 28, a tube-like member 48 which is rigidly supported relative to the housing 26. The poppet valve 28 cooperates with a annular knife edge valve seat 50 formed at one end of a cylindrical valve body 52. The valve body 52 is provided with a bore 54 in communication with a port 56 which extends through the valve body 52. The port 56 in turn is in fluid communication with an annular recess 58 formed on the external surface of the valve body 52, the recess 58 being in communication with the air line 18 by means of a conventional fitting mounted on a cylindrical portion 26.1 of the housing 26 about the port 56.

A restrictor 60 is mounted within the tube-like member 48 and a light spring 62 extends between one end of the restrictor 60 and an end of the poppet valve 28 to bias the poppet valve 28 to the left-hand position shown in FIG. 2. When the poppet valve 28 is in the left-hand position shown in FIG. 2, it will bear against the valve seat 50 to prevent the flow of air into the mask. However, if the pressure within the mask should fall below the pressure established by the positive pressure spring 42, the poppet valve 28 will be shifted to the right by the valve operating means to permit air under pressure to be introduced into the mask. To this end, the demand valve operating means 30 further includes, in addition to the diaphragm assembly 36, a first pivoted lever 64 which has one end 64.1 pivotally mounted on a portion of the housing 26, and which has another end 64.2 maintained in contact with the diaphragm assembly 36, due to the action of spring 62, at least when the diaphragm assembly 36 is in its static position as shown in FIG. 1. (When the diaphragm is in its static position, the positive pressure established by the positive pressure spring 42 is suitably balanced by the pressure within the pressure sensing cavity 44, the pressure within the mask 12 being the same.) The valve operating means further includes a second pivoted lever 66 which has an intermediate portion 66.1 pivoted within a portion of the housing 26. An upper end portion 66.2 of lever 66 is in the form of a loop. It will be held in engagement with an intermediate portion 64.3 of the first lever by action of the spring 62. The lower portion 66.3 of lever 66 is disposed within a groove 28.1 of the demand valve 28.

The operation of the pressure demand regulator 14 is well known in the art, but it should be noted briefly that when the wearer of the mask inhales that the pressure within the pressure sensing chamber will drop, and the diaphragm will move inwardly towards the pressure sensing cavity to move the lever mechanism 64 from its static full-line position to its dotted-line position. As this happens, the lever 66 will pivot about its intermediate portion 66.1 to shift the valve 28 away from the seat 50 against the action of the spring 62 to permit air to flow into the breathing mask through passageways 70, 72, and 74.

Figure 4:
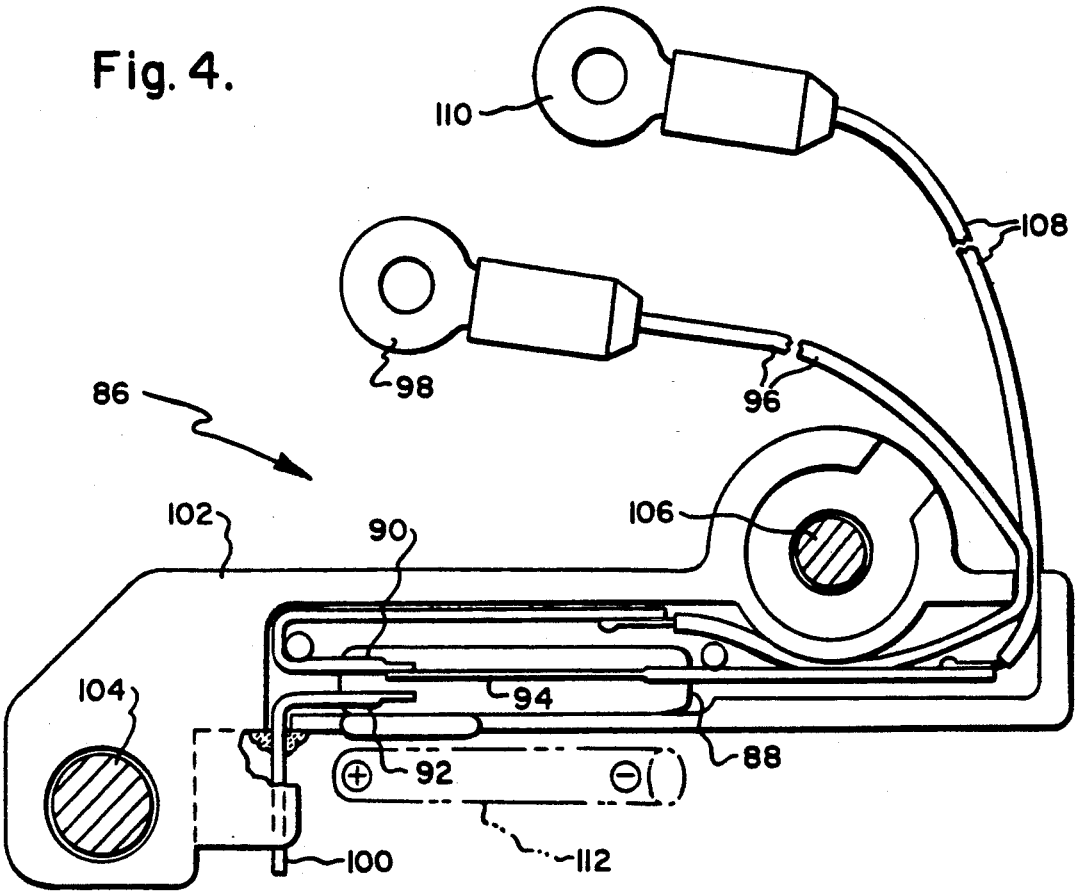
FIG. 4 is an enlarged detailed view of a portion of the device shown in FIG. 3, parts being eliminated and rotated for purposes of clarity.
Figure 5:
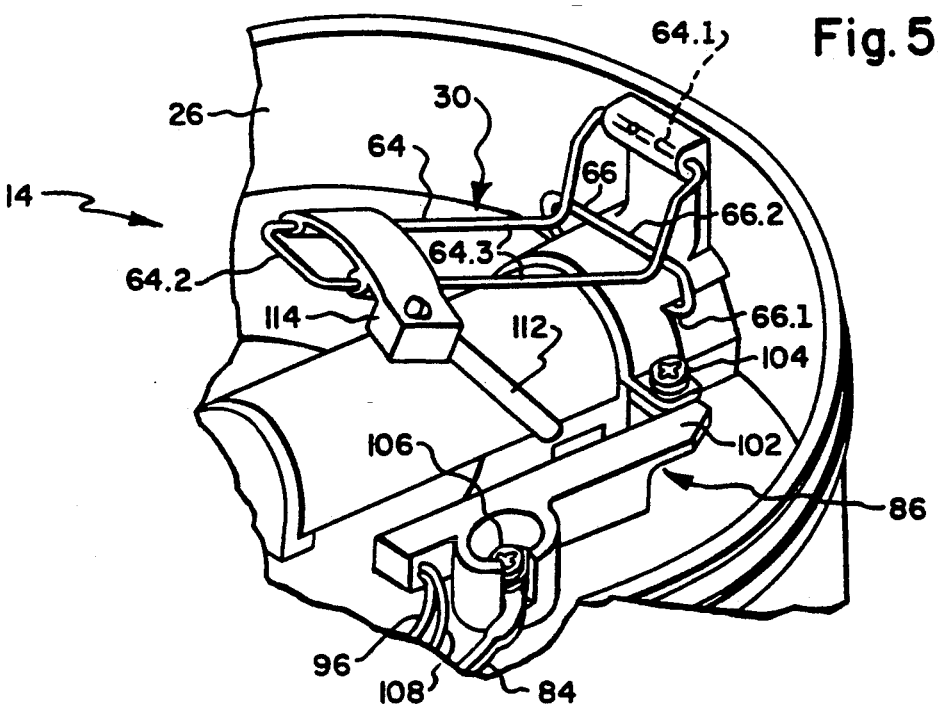
FIG. 5 is a perspective view of a portion of the structure shown in FIG. 3.

As previously indicated the microphone circuit associated with the breathing apparatus includes a microphone 20. The microphone 20, which is of the sound canceling type, is mounted within a rubber housing 76 in such a manner that it will be near the mouth of the user when the breathing mask is worn as shown in FIG. 1. A pair of snap contacts 78, 80 are mounted on the exterior of the regulator housing 26, and these contacts are in turn connected to the microphone. Thus, the microphone is provided with a pair of lead wires 82, 84. One of the lead wires 82 is connected directly to the snap contact assembly 78. The other lead wire 84 from the microphone is connected to a switch which is generally indicated at 86. The switch, which is illustrated in FIG. 4, is a single-pole, double-throw magnetic reed switch. The switch 86 is normally closed as shown in FIG. 4. Reed switches are well known in the art and they typically include a glass enclosure 88. The type of reed switch illustrated has a pair of spaced apart rigid metallic contacts 90, 92 extending into one end. A metallic reed 94 extends through the enclosure 88 to a location where one of its ends is spaced between the contacts 90, 92. The parts 92 and 94 are made of a magnetic material, although contact 90 is non-magnetic. The reed 94 is so designed that it is normally spring biased into contact with the rigid contacts 90, but the reed may be moved in response to a magnetic force into contact with the other contact 92. To this end the other contact 92 has a pigtail which can pick up a magnetic flux to magnetically shift the reed 94. Thus, in the design shown in FIG. 4, the reed 94 is normally spring biased into contact with a contact 90. In the circuit illustrated the contact 90 is in turn connected to a lead wire 96 having a suitable terminal 98. The other contact 92 is provided with pigtail 100. The switch 86 is supported by a switch housing 102 which is suitably mounted in the pressure sensing cavity 44 by screws 104, 106 which engage the housing 26. Screw 106 also serves as an electrical junction device since the terminal 98 is provided with an aperture for the receipt of screw 106. The terminal 98 is in turn connected to a further terminal (not shown) disposed on the end of the microphone lead wire 84. Finally, the switch 86 is further provided with another lead wire 108 having a terminal 110, the end of the wire 108 remote from terminal 110 being connected to that portion of the reed 94 which extends outwardly of the glass enclosure, and terminal 110 being connected to snap contact 80 as shown in FIG. 3.

It can be seen from an inspection of FIGS. 3 and 4 that when the reed switch is in its normal position as shown in FIG. 4 that the microphone will be in electrical contact with the snap contacts 78 and 80. Thus, lead wire 82 will extend directly from the microphone to contact 78. The other microphone lead wire 84 will be in electrical contact with lead wire 96 by means of the terminal (not shown) on the end of lead wire 84, screw 106, end terminal 98. The lead wire 96 is of course in electrical contact with the contact 90 which is in electrical contact with the reed 94 which is in turn in electrical contact with lead wire 108 and terminal 110. The terminal 110 is in electrical contact with snap contact 80 as can be seen from FIG. 3. If the reed 94 were moved to its second or open position by means of magnetic influence upon pigtail 100, it can thus be seen that the microphone circuit would be opened and that the microphone would no longer be in contact with the communications device 22.

In order to cause the normally closed switch to move between its normally closed position, shown in FIG. 4, to its normally open position it is necessary to subject the pigtail 100 to a magnetic flux. To this end, a magnet 112 is mounted upon a magnet holder 114 which is turn supported by pivoted lever 64. The ends of the magnet 112 have opposite polarities. As the pivoted lever is caused to be moved as the pressure within the pressure sensing cavity is reduced, it will carry the magnet 112 towards the pigtail to impose upon the pigtail 100 and the contact 92 sufficient magnetic flux to cause the reed 94 to switch from its normal position shown in FIG. 4 to an alternate position where it is figuratively in contact with the contact 92. This will open the microphone circuit and will prevent the transmission of sound from the microphone to the communications device. Thus, the magnet performs the function of a switch operating device which moves the switch 86 from its first position (such as that shown in FIG. 4) to another position, the switch operating means 12 being responsive to the valve operating means 36, 64, 66 during a pressure change in the pressure sensing cavity. The magnet 112 is mounted in such a manner that as it is moved downwardly towards the pigtail 100 not only will the pigtail be influenced by the magnetic flux from one pole of the magnet, but the reed 94 will be influenced by the magnetic flux from the other pole. This dual action will increase the response of the reed switch 86 and will reduce hysteresis. The pigtail 100 has been configured and positioned in such a manner relative to the magnet 112 so as to provide a readily available and easily actuated means for adjusting the toggle position of the on/off mechanism relative to the individual regulator static position as required by tolerance variations in the assemblies.

The present invention, as described above has significant advantages over known prior art. Thus, in the event that the switch should fail, it does not have any adverse affects upon the performance of the breathing device. In addition, as speech only takes place during exhalation, no sound will be transmitted during inhalation. It has been found in testing that there is very little hysteresis in the system when the magnet is mounted in the manner illustrated in these drawings.

A preferred embodiment in which the principles of the present invention has been incorporated is shown and described above, it is to be understood that this invention is not to be limited to the particular details shown and described above, but that, in fact, widely differing means may be employed in the practice of the broader aspects of this invention.

What is claimed is:

1. A microphone circuit control mechanism in combination with a breathing apparatus having a microphone circuit, the control mechanism being capable of toggling the microphone circuit between "off" and "on" states; the combination comprising:

a breathing apparatus including a breathing mask, a regulator operably disposed between a source of air under pressure and the breathing mask for regulating the flow of air under pressure into the breathing mask, the regulator including a pressure sensing cavity in fluid communication with the interior of the mask, a demand valve for admitting air into the breathing mask when opened, and valve operating means movable in response to a drop in pressure in the pressure sensing cavity to open the demand valve, and a microphone circuit including a microphone associated with the breathing mask and a communications device associated with the microphone; and wherein the improvement comprises a microphone circuit control mechanism including a switch in the microphone circuit, the switch being movable between open and closed positions, the microphone being in circuit with the communications device when the switch is in a first position but not in circuit with the communications device when the switch is in its other position, and switch operating means for toggling the switch from its first position to its other position in response to movement of said valve operating means as it moves in response to a drop in pressure in the pressure sensing cavity.

2. The microphone circuit control mechanism as set forth in claim 1 wherein the valve operating means includes a diaphragm disposed to one side of the pressure sensing cavity, the diaphragm being movable inwardly into the pressure sensing cavity from a static position towards an inner position in response to a drop of pressure within the pressure sensing chamber, which drop in pressure may be caused by an inhalation effort on the part of the wearer of the breathing mask.

3. The microphone circuit control mechanism as set forth in claim 2 wherein the valve operating means includes a pivoted lever having an end maintained in contact with the diaphragm when the diaphragm is in its static position, the pivoted lever being movable in response to movement of the diaphragm inwardly into the pressure sensing cavity during an inhalation effort, wherein the switch is a magnetic reed switch, and wherein the switch operating means includes a permanent magnet carried by the pivoted lever.

4. The microphone circuit control mechanism as set forth in claim 2 wherein the regulator is further provided with a positive pressure spring acting upon one side of the diaphragm, the static operating pressure within the pressure sensing cavity being positive when the breathing mask is worn and the wearer is not inhaling, and the positive pressure spring and ambient pressure acting upon the diaphragm to move it into the pressure sensing cavity when the static operating pressure within the pressure sensing cavity is reduced.

5. The microphone circuit control mechanism as set forth in claim 4 wherein the switch is a single-pole double-throw magnetic reed switch having a reed movable between a pair of spaced apart contacts, and wherein the switch operating means includes a magnet.

6. The microphone circuit control mechanism as set forth in claim 5 wherein the switch is normally closed, the magnet causing the normally closed switch to move to its open position in response to a drop in pressure in the pressure sensing cavity.

7. The microphone circuit control mechanism as set forth in claim 5 wherein the reed switch is disposed within the pressure sensing cavity of the regulator.

8. The microphone circuit control mechanism as set forth in claim 5 wherein the magnet is mounted in such a manner that as it is moved towards the reed switch the opposite poles of the magnet will act upon the reed and that contact which is to be contacted when the switch is in its other position.

9. The microphone circuit control mechanism as set forth in claim 5 wherein the reed switch is provided with a pigtail configured and positioned in such a manner relative to the magnet that it may be easily adjusted to adjust the location where the switch is toggled.

10. The microphone circuit control mechanism as set forth in claim 2 wherein the switch is a single-pole double-throw magnetic reed switch having a reed movable between a pair of spaced apart contacts, and wherein the switch operating means includes a magnet.

11. The microphone circuit control mechanism as set forth in claim 10 wherein the switch is normally closed, the magnet causing the normally closed switch to move to its open position in response to a drop in pressure in the pressure sensing cavity.

12. The microphone circuit control mechanism as set forth in claim 10 wherein the reed switch is disposed within the pressure sensing cavity of the regulator.

13. The microphone circuit control mechanism as set forth in claim 10 wherein the magnet is mounted in such a manner that as it is moved towards the reed switch the opposite poles of the magnet will act upon the reed and that contact which is to be contacted when the switch is in its other position.

14. The microphone circuit control mechanism as set forth in claim 10 wherein the reed switch is provided with a pigtail configured and positioned in such a manner relative to the magnet that it may be easily adjusted to adjust the location where the switch is toggled.

15. The microphone circuit control mechanism as set forth in claim 1 wherein the switch is a single-pole double-throw magnetic reed switch having a reed movable between a pair of spaced apart contacts, and wherein the switch operating means includes a magnet.

16. The microphone circuit control mechanism as set forth in claim 15 wherein the switch is normally closed, the magnet causing the normally closed switch to move to its open position in response to a drop in pressure in the pressure sensing cavity.

17. The microphone circuit control mechanism as set forth in claim 5 wherein the reed switch is disposed within the pressure sensing cavity of the regulator.

18. The microphone circuit control mechanism as set forth in claim 15 wherein the magnet is mounted in such a manner that as it is moved towards the reed switch the opposite poles of the magnet will act upon the reed and that contact which is to be contacted when the switch is in its other position.

19. The microphone circuit control mechanism as set forth in claim 15 wherein the reed switch is provided with a pigtail configured and positioned in such a manner relative to the magnet that it may be easily adjusted to adjust the location where the switch is toggled.

* * * * *